US005211350A

United States Patent [19]

Ritter et al.

[11] Patent Number: 5,211,350

[45] Date of Patent: May 18, 1993

[54] SYSTEM FOR PRODUCING STRAPPED ROLLS OF WIRE SCREENING

[75] Inventors: Klaus Ritter; Gerhard Ritter; Gerhard Schmidt, all of Graz, Austria

[73] Assignee: EVG Entwicklungs- u. Verwertungs-Gesellschaft m.b.H., Graz, Austria

[21] Appl. No.: 688,575

[22] PCT Filed: Sep. 28, 1990

[86] PCT No.: PCT/AT90/00096

§ 371 Date: May 23, 1991

§ 102(e) Date: May 23, 1991

[87] PCT Pub. No.: WO91/04807

PCT Pub. Date: Apr. 18, 1991

[30] Foreign Application Priority Data

Oct. 4, 1989 [AT] Austria ..... A 2299/89

[51] Int. Cl.[5] ..... B21C 47/24; B65B 27/06

[52] U.S. Cl. ..... 242/79; 53/589; 242/81

[58] Field of Search ..... 242/79, 81, 56 R; 53/118, 589, 587

[56] References Cited

U.S. PATENT DOCUMENTS

| | | | |
|---|---|---|---|
| 2,198,644 | 4/1940 | Wettengel | 242/81 |
| 2,818,795 | 1/1958 | Gustafson | 53/589 X |
| 3,032,289 | 5/1962 | Frederiksson et al. | 242/79 |
| 3,424,398 | 1/1969 | Garnier | 242/81 |
| 4,333,301 | 6/1982 | Koutonen et al. | 53/589 X |
| 4,512,529 | 4/1985 | Kampf | 242/79 X |
| 4,669,247 | 6/1987 | Woffendin | 242/81 X |
| 4,944,139 | 7/1990 | Neilsen et al. | 53/589 X |

FOREIGN PATENT DOCUMENTS

| | | | |
|---|---|---|---|
| 276028 | 11/1969 | Austria . | |
| 375051 | 6/1984 | Austria . | |
| 505787 | 8/1930 | Fed. Rep. of Germany | 242/81 |
| 1295466 | 5/1969 | Fed. Rep. of Germany . | |
| 1449498 | 8/1966 | France . | |
| 2578222 | 9/1986 | France . | |

*Primary Examiner*—Daniel P. Stodola
*Assistant Examiner*—John Rollins
*Attorney, Agent, or Firm*—Frishauf, Holtz, Goodman & Woodward

[57] ABSTRACT

A system for producing strapped rolls of wire screening having a windup device (3), which has a driven windup mandrel (4) for winding up the wire screening delivered to it, and a guide device for threading the wire screening into the windup mandrel, having a strip-off device (23), with which the wound roll of wire screening is movable in the axial direction relative to the windup mandrel, having a gripper mechanism, which has at least two mutually independent units of gripper arms (19, 20, 21), which are pivotable from above and below toward the outer surface of the roll of wire screening, wherein the gripper mechanism is adjustable in a controlled manner into freely selectable positions, parallel to the windup mandrel axis, by means of a carriage (16) movable on rails (17), and having a surrounding strap application device for the wound roll of wire screening, with a strapping frame (28) that is likewise mounted on a carriage (26) in a manner adjustable at right angles to the windup mandrel axis, and being movable with this carriage parallel to the windup mandrel axis (x—x) on rails (25) in a controlled manner to freely selectable strapping positions, wherein the gripper arms of each gripper arm unit are pivotable in a controlled manner away from the roll of wire screening in order to move past the strapping frame.

4 Claims, 1 Drawing Sheet

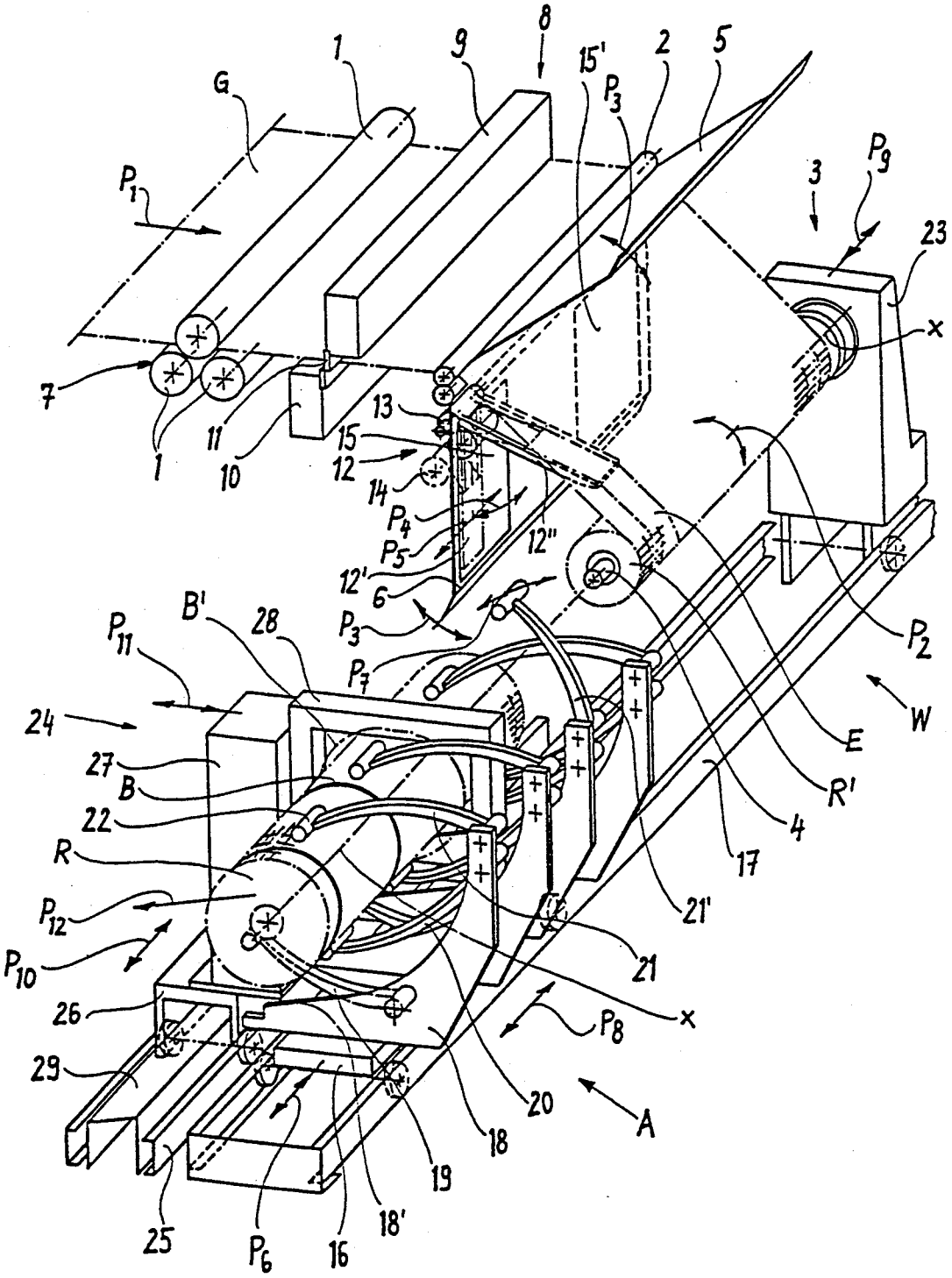
G
1
9
8
15'
2
5
P3
P1
3
P9
23
x
7
1
11
10
13
15
12
14
P4
P5
12'
12"
6
P3
P7
B'
28
P11
24
27
B
22
R
P12
P10
26
29
25
P6
16
18'
19
18
20
21
21'
17
4
R'
E
W
P2
P8
x
A

SYSTEM FOR PRODUCING STRAPPED ROLLS OF WIRE SCREENING

FIELD OF THE INVENTION

The invention relates to a system for producing strapped rolls of wiring screening, or mesh.

BACKGROUND

It is known to provide a system having a windup device that has a driven windup mandrel for winding up wire screening delivered to it, and a guide for threading the wire screening into the windup mandrel. A strip-off device is provided with which the wound wire screening roll is movable relative to the windup mandrel in the axial direction. A gripper mechanism that has gripper arms is pivotable from above and below toward the outer surface of the roll of wire screening and is movable by means of a transport device from a first position, in which it receives the roll of wire screening in the region of the windup device by means of the gripper arms, via a distance exceeding the length of the roll in the direction of the windup mandrel axis, into a second position remote from the windup mandrel. A surrounding strap application device for the wound roll of wire screening is provided, with a surrounding strapping frame for a surrounding strapping element.

A system of this above-described type, known from Austrian Patent 276.028, has the disadvantage that the gripper, mechanism is movable from the first position to the second position only passively with the aid of an ejector plate, a stationary surrounding strap application device being provided in the second position. Finely sensitive operation of the strap application device and adaptation of it to various dimensions of screening rolls or strapping requirements is therefore impossible.

THE INVENTION

The object of the invention is to overcome this disadvantage and to create a system of the type generally described above with which the roll of wire screening can be tied off with great accuracy at arbitrary points along the length of the roll with the aid of surrounding strapping elements.

Briefly, the system according to the invention has the characteristics that the gripper mechanism has at least two gripper arm units that are independent of one another and are provided with associated retainers and is adjustable to freely selectable positions in a controlled manner parallel to the axis of the windup mandrel by means of a carriage carrying the gripper mechanism and movable on rails in a manner known per se, and that the strapping frame, adjustable in a manner known per se at right angles to the axis of the windup mandrel, is likewise mounted on a carriage and is movable with this carriage on rails, in a controlled manner parallel to the axis of the windup mandrel, to freely selectable strapping positions, the gripper arms of each gripper unit being pivotably away from the roll of wire screening in a controlled manner in order to move past the strapping frame.

With this system, operation of the windup device is essentially continuous and at the same time accurately controlled adjustment of the roll of screening relative to the strapping devices is attained, which enables automatic strapping at arbitrary points of the roll of screening. In moving past the strapping frame, the gripper arms of one unit are each pivoted away in alternation, while the gripper arms of the remaining units securely hold the roll of screening and thus prevent the roll of screening from becoming twisted, dropping at one end, or unintentionally becoming wound up.

In a preferred embodiment of the invention, the retainers of the gripper arm units are formed by bearing plates adjustable relative to one another in the direction of the axis of the windup mandrel and oriented transversely to this mandrel; these plates are mounted on the gripper mechanism carriage, and the pivot bearings for the gripper arms are provided on them above and below the axis of the windup mandrel. The gripper arms preferably grip the roll of wire with their free ends, via retainers extending parallel to the windup mandrel axis and preferably being adjustable in the direction parallel to that axis. With this embodiment, secure but gentle holding of rolls of wire screening various diameters is achieved.

DRAWINGS

The single FIGURE illustrates an exemplary embodiment schematically and partly shown in exploded perspective.

From a welding machine, not shown, for producing wire screening or a supply of wire screening, not shown, a web G of screening is delivered in the direction of the arrow $P_1$, with the aid of driven transport and retaining rollers 1 and between a pair of guide rollers 2, to a windup device 3, shown only schematically. The windup device 3 has a windup mandrel 4, drivable by means of bearing and drive devices, not shown, in the direction of the double arrow $P_2$, and an upper guide baffle 5 and lower guide baffle 6, which are each pivotable toward and away from one another as indicated by the double arrow $P_3$. At the beginning of the windup process, the guide baffles 5, 6 are pivoted toward one another and form a guide passage, via which the beginning portion of the web of screening is guided exactly onto the windup mandrel 4, which facilitates the threading in and fixation of the web of screening on the windup mandrel 4.

During the winding process, the length of the web G of screening is measured continuously with the aid of a length measuring device 7 associated with the transport and retaining rollers 1. Once the desired production length is attained, the web of screening is cut off from the supply of material with the aid of a cutter device 8, following the measuring device and essentially comprising an upper shearing bar 9, provided with a knife 11, and a lower shearing bar 10, likewise provided with a knife.

In the pivoting range of the lower guide baffle 6, a label applicator 12 is provided which, when the lower guide baffle 6 has been pivoted downward away from the wire screening, can be pivoted through a portion 15 of the guide baffle 6 about a suspension 13 from an outset position 12' corresponding to the double arrow $P_4$ to a working position 12" pointing tangentially toward the windup mandrel 4; in this working position, the label applicator 12 essentially touches the underside of the web of screening. Shortly before a roll R' of screening is completed, labels E, which for instance contain product data, are continuously wound in with the roll R' of screening by the label applicator. The labels E are taken from a label magazine 14 and as needed can either be cut from a supply material or be in the form of single sheets. The label applicator 12 is adjustable inside the portion 15 of the lower guide baffle 6 parallel to the axis x—x of the windup mandrel as indicated by the double arrow $P_5$, so that the position of the label applicator 12 can be adapted to various widths of the screening web to be wound up and that the position of the wound-in label E can be adjusted relative to the edge of the web of screening.

Since the windup device 3 can be designed for simultaneously winding up two parallel webs of screening, or two labels per roll of screening may perhaps be desired, the lower guide baffle 6 has a second portion 15', which can receive a second label applicator, not shown.

A transport carriage 16 is movable as indicated by the double arrow $P_6$ parallel to the direction of the windup mandrel axis x—x on rails 17, from a transfer position W in which the carriage receives the roll R' of screening from the windup device 3 to a tie-off position A. The transport carriage 16 carries a plurality of bearing plates 18 oriented transversely to the lengthwise direction of the carriage, and on each bearing plate there are three gripper arms 19, 20, 21 forming one gripper arm unit, supported pivotably about axes parallel to the windup mandrel axis x—x as indicated by the double arrow $P_7$. The bearing plates 18 are adjustable relative to one another parallel to the windup mandrel axis x—x as indicated by the double arrow $P_8$, to enable adaptation of the relative position of the gripper arms to the length of the roll R' of screening to be received. Shortly before the web of screening is cut from the supply of material, the gripper arms are placed in contact with the roll R' of screening, the pressing force being adjusted such that the severed end of the web can be wound up without damaging the roll R' of screening.

The free end of each gripper arm engaging the roll R' of screening, has a tubular holder elements 22, which is attached, displaceable parallel to the windup mandrel axis, to the free end of the gripper arms. Its length is designed such that the mesh width of the screening roll is firmly held. The three arms of each gripper unit are mounted on the associated bearing plate 18 such that the bearings of two arms 20, 21 are located above the windup mandrel axis x—x, while the bearing of one arm 19 is below the windup mandrel axis. The roll R' of screening is supported from below by the gripper arms 19, 20, while the gripper arm 21 holds the roll R' of screening down from above. The gripper arms 19, 20, 21 of one gripper arm unit can be pivoted singly or jointly with the aid of actuation elements, not shown. Once one roll R' of screening has been completely wound up and the gripper arms 19, 20, 21 of the transport carriage 16 have been placed in contact with it, the roll R' is carried along by the transport carriage, and at the same time is pushed off the windup mandrel 4 by a strip-off carriage 23 that is adjustable parallel to the windup mandrel axis x—x on the rails 17 as indicated by the double arrow $P_9$ and has an opening for the windup mandrel 4 to pass through. The roll R' of screening is transported by the transport carriage 16 out of the transfer position W to the tie-off position A, which is located axially so far outside the windup device 3 that the roll R' leaves the windup mandrel 4 completely exposed. Once the strip-off carriage 23 has been restored to its outset position, the windup device 3 is immediately ready to wind up a new roll of screening. To make it easier to release the roll R' of screening from the windup mandrel 4, the windup mandrel 4 can be wound backward, counter to the original winding direction.

To tie off a roll R of screening, located on the tie-off position A, a surrounding strap application device 24 is provided. The strapping device 24 has a traveling carriage 26 movable on a track 25 as indicated by the double arrow $P_{10}$, parallel to the longitudinal axis of the roll R of screening to be tied-off, and a stand 27 that is adjustable perpendicular with respect to the roll R on the traveling carriage 26 as indicated by the double arrow $P_{11}$. Projecting from the stand 27 is a surrounding strapping frame 28, which surrounds the roll R to be tied off and wraps a strapping band B, located in the strapping frame 28, in the form of a loop B' around the roll R of screening. The strapping band B may take various forms within the scope of the invention and may comprise the most various materials, such as plastic strips or metal bands. Elements for strapping, not shown, such as a supply magazine for the strapping band, a closure unit and a cutter device for the strapping band, are accommodated in the strapping frame 28.

For the tie-off procedure, the strapping device 24 is moved as indicated by the double arrow $P_{10}$ parallel to the longitudinal axis of the roll R of screening to be tied off to a position at which the strapping band B is to be wrapped around the roll R. Next, the stand 27 is displaced as indicated by the double arrow $P_{11}$ far enough toward the roll R that the inside of the strapping frame 28 toward the stand rests precisely on the roll R of screening. The loop B' of the strapping band is tightened and then closed at the closure station, and the strapping band is then severed from the supply of material. Next, the stand 27 moves back to its outset position as indicated by the double arrow $P_{11}$.

To provide the roll R of screening with a strapping band B at a further point along its length, the strapping device 24 is adjusted along the fixed transport carriage 16 and thus along the roll R of screening in the direction indicated by the double arrow $P_{10}$ with the aid of the traveling carriage 26, and positioned at a new point. Within the scope of the invention it is also possible for the strapping device 24 to be stationary, while the transport carriage 16 along with the roll R of screening to be tied off is displaced as indicated by the double arrow $P_6$ far enough that the strapping band B' in the strapping frame 28 is in alignment with the new point on the roll R of screening to be strapped.

Since gripper arms of the various gripper arm units would hinder the relative motions between the strapping device 24 and the transport carriage 16, to avoid a collision the gripper arms of one unit are each pivoted briefly away from the roll of wire screening, as shown for example at 21' for the upper gripper arm, far enough that the gripper arms and the strapping feature 28 can pass unhindered past each other. Once the danger of collision between the strapping frame 28 and the corresponding gripper arms of a unit is past, the gripper arms immediately close again around the roll R of screening. Since the other closed gripper arms, during the opening and closing motion of a gripper arm unit, must be capable of continuing to securely hold the roll R of screening in its position, the number of bearing plates 18, each supporting one gripper arm unit, and the length of the tubular retainers 22 are adapted to the length of the roll R of screening to be tied off; however, at least two bearing plates 18 for the transport carriage 16 are necessary.

Once the strapping process is ended, the strapping device 24 is returned to its outset position, or the transport carriage 16 is displaced far enough that the completely strapped roll R of screening, after all the gripper arms have been opened, can roll off in the direction of the arrow $P_{12}$ via an inclined and suitably tiltable roll-off plate 29. To enable the rolls to roll off, the bearing plates 18 are formed generally in a curved manner transversely to the windup mandrel axis x—x, and with suitable beveled portions 18' form a chute for the roll R of screening.

The actuating and control devices necessary to carry out the motions of the various devices and elements of the system according to the invention have been left out of the drawing for the sake of simplicity. In particular, a central control system for the entire operating cycle is provided.

The character of the surface of all the devices (1, 2, 4, 5, 6, 7, 18', 22, 29) coming into contact with the web G of screening to be wound up and with the roll R of screening to be tied off is adapted to the character of the surface of the wire screening, such that damage to the surface of the wire screening is avoided. For example, to wind up and tie off plastic-coated wire screens, the devices are preferably provided with gummed surfaces.

It is understood that the system explained can be modified in various ways within the scope of the general concept of the invention. For instance, shell-shaped retainers may be provided instead of the tubular retainers, making it possible optionally to make do with only two gripper arms per gripper arm unit. Depending on the size of the roll of wire screening to be received and on the design of the retainers, it is also possible for only two gripper units to be provided on the transport carriage.

We claim:

1. A system for producing strapped rolls of wire screening or mesh having a windup device (3) including a driven mandrel (4);

means (1, 7; $P_1$) for delivering wire screening or mesh to the windup device, include guide means (5, 6) for feeding the wire screening or mesh on the mandrel;

a stripper device (23) axially movable with respect to the mandrel for stripping wound-up, or rolled-up wire screening or mesh from the mandrel (4);

a plurality of gripper arm units (18, 19, 20, 21), each including movable gripper arms (19, 20, 21), and support means (18) for movably supporting the movable gripper arms;

a gripper carriage means (16, 17) for simultaneously moving said gripper arm units with respect to said mandrel (4), said gripper carriage means being movable between a first position (W), in which the gripper arm units engage the wound-up roll of wire screening or mesh on the winding device and a second position (A) spaced from the first position (W) by a distance exceeding the length of the roll of wire screening or mesh in the direction of the windup mandrel axis (x—x), and remote from the wind-up mandrel (4), each of said gripper arm units being mounted on said gripper carriage means for independent movement relative to the other of said gripper arm units; and a strapping unit, said strapping unit including a strapping frame (28) adjustable at right angles with respect to the (axis x—x) of the winding mandrel (4) and a strapping frame carriage means (26) for moving said strapping frame relative to said axis of said mandrel and guide means (25), supporting the strapping frame carriage means, the strapping frame carriage means supporting the strapping frame (28) for movement parallel with respect to the axis (x—x) of the windup mandrel (4) to freely selectable strapping positions axially on the roll of wound wire screening of mesh; and wherein the gripper arms (19, 20, 21) of at least one of said gripper arm units are pivotably mounted on the support means (18) for movement towards and away from the roll of wire screening or mesh in a controlled manner to permit, selectively, gripping of the wire screening or mesh roll by the gripper arms and passage of the strapping frame carriage means (26) and the strapping frame (28) thereon past said at least one gripper arm unit.

2. The system of claim 1, wherein the support means (18) of the gripper arm units comprise bearing plates (18) oriented transversely to the axis (x—x) of the mandrel (4) and adjustable relative to one another in the direction of the mandrel axis, said bearing plates (18) being mounted on the gripper carriage means (16); and wherein pivot bearings are provided, located on said bearing plates (19, 20, 21), for pivotably mounting the gripper arms (19,20, 21) for pivotable movement of respective selected arms above and below the mandrel windup axis (x—x).

3. The system of claim 2, wherein the gripper arms (19, 20, 21) include tubular end elements (22), positioned at the free ends thereof, said tubular elements (22) extending parallel to the axis (x—x) of the mandrel (4), and optionally adjustable in a direction parallel to said mandrel axis (x—x).

4. The system of claim 1, wherein the gripper arms (19, 20, 21) include tubular end elements (22), positioned at the free ends thereof, said tubular elements (22) extending parallel to the axis (x—x) of the mandrel (4), and optionally adjustable in a direction parallel to said mandrel axis (x—x).

* * * * *